United States Patent [19]

Davis

[11] 4,449,638

[45] May 22, 1984

[54] TAMPER-RESISTANT AND CHILD-RESISTANT CLOSURE AND CONTAINER ASSEMBLY

[75] Inventor: Eugene E. Davis, Ilford, England

[73] Assignee: Johnsen & Jorgensen (Plastics) Ltd., London, England

[21] Appl. No.: 507,120

[22] Filed: Jun. 23, 1983

[30] Foreign Application Priority Data

Dec. 9, 1982 [GB] United Kingdom ..... 8235090

[51] Int. Cl.[3] ..... B65D 55/02

[52] U.S. Cl. ..... 215/211; 215/206; 215/224; 215/256

[58] Field of Search ..... 215/211, 206, 224, 225, 215/253, 254, 256

[56] References Cited

U.S. PATENT DOCUMENTS

| | | | |
|---|---|---|---|
| 4,043,475 | 8/1977 | Wheeler | 215/224 |
| 4,065,017 | 12/1977 | Burton | 215/211 |
| 4,071,156 | 1/1978 | Lowe | 215/224 |
| 4,353,472 | 10/1982 | Burton et al. | 215/211 |

*Primary Examiner*—George T. Hall

*Attorney, Agent, or Firm*—Barnes & Thornburg

[57] ABSTRACT

This invention provides a container and closure assembly in which the container has an open mouth, a rim around the mouth, a cut-out in the rim and annular closure retaining means below the rim and in which the closure has a top to close the mouth of the container, an inner depending plug to enter the mouth of the container, a tear band, means shaped to engage with the closure retaining means on the container and a thumb-receiving recess in the plug.

8 Claims, 12 Drawing Figures

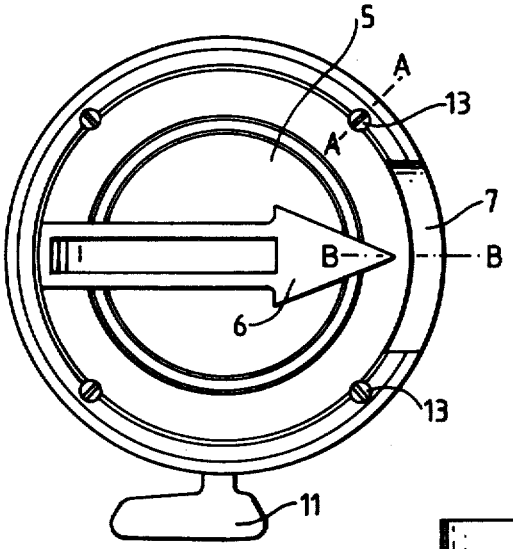
Fig.1.
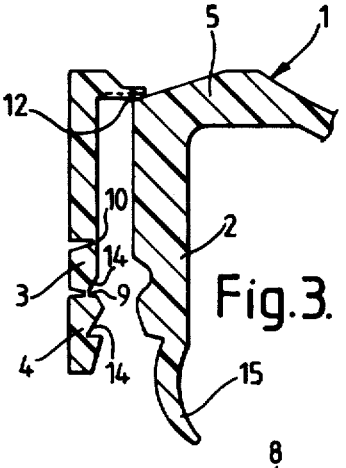
Fig.3.
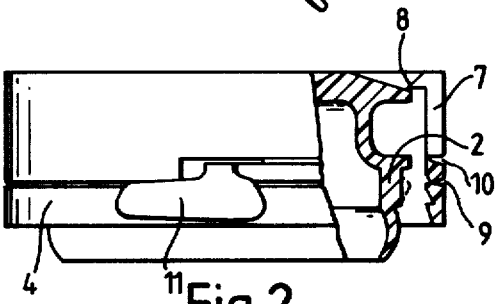
Fig.2.
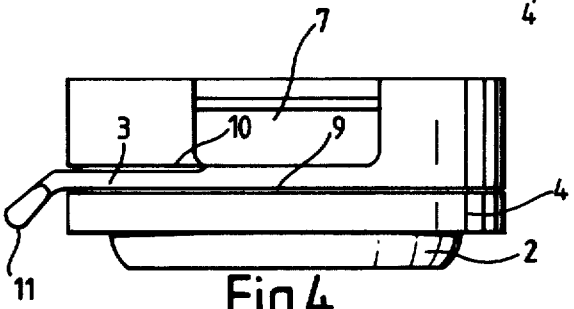
Fig.4.
Fig.6.
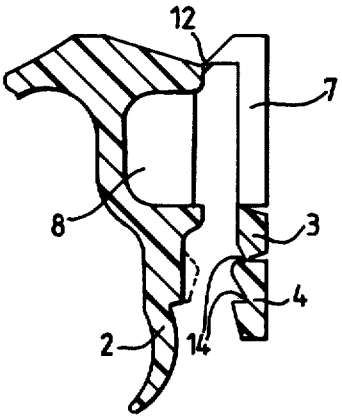
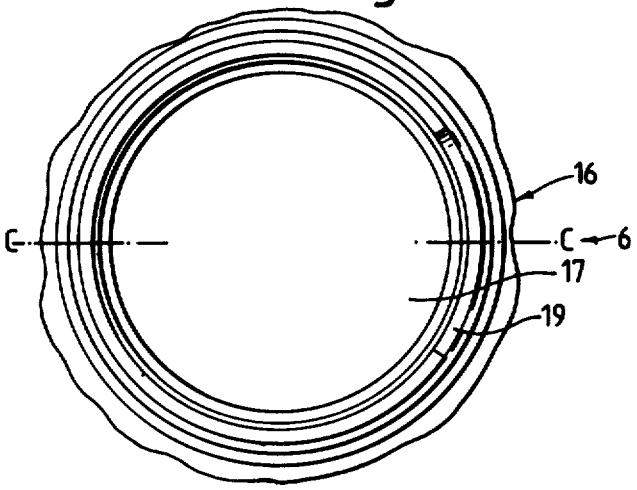

TAMPER-RESISTANT AND CHILD-RESISTANT CLOSURE AND CONTAINER ASSEMBLY

This invention is concerned with the provision of a tamper-resistant and child-resistant closure and container assembly. The invention also includes a closure for use with a container and a container for use with a closure.

According to the invention we provide a container and closure assembly wherein the container has an open mouth preferably at one end through which the container can be filled, a rim around the mouth, an opening or cut out in the rim and annular closure retaining means below the rim and wherein the closure has a top to close the mouth of the container, an inner depending plug to enter the mouth of the container, a tear band, means shaped to engage with the closure retaining means on the container and a finger or thumb-receiving recess in the plug. The annular closure retaining means on the container preferably comprises one or a plurality of annular projecting beads under which the tear band and/or a collar on the closure is or are shaped to fit. The assembly is preferably moulded from a suitable plastics material.

In order that the invention may be more fully understood, reference is now directed to the accompanying drawings given by way of example in which:

FIG. 1 is a top plan view of the closure,

FIG. 2 is a sectional side elevation of the closure,

FIG. 3 is a detail sectional view on line A—A of FIG. 1,

Figure 7:
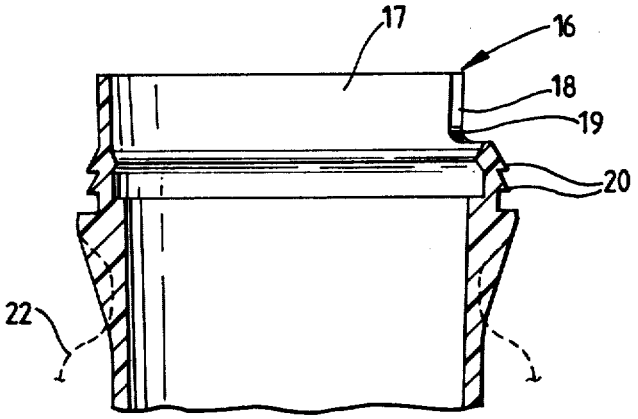
Figure 8:
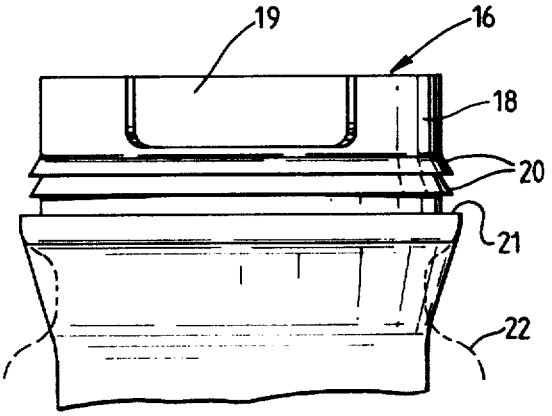
Figure 9:
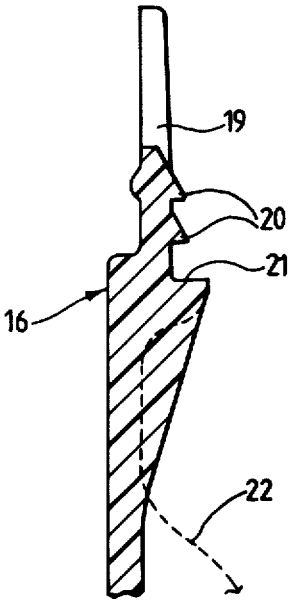
Figure 10:
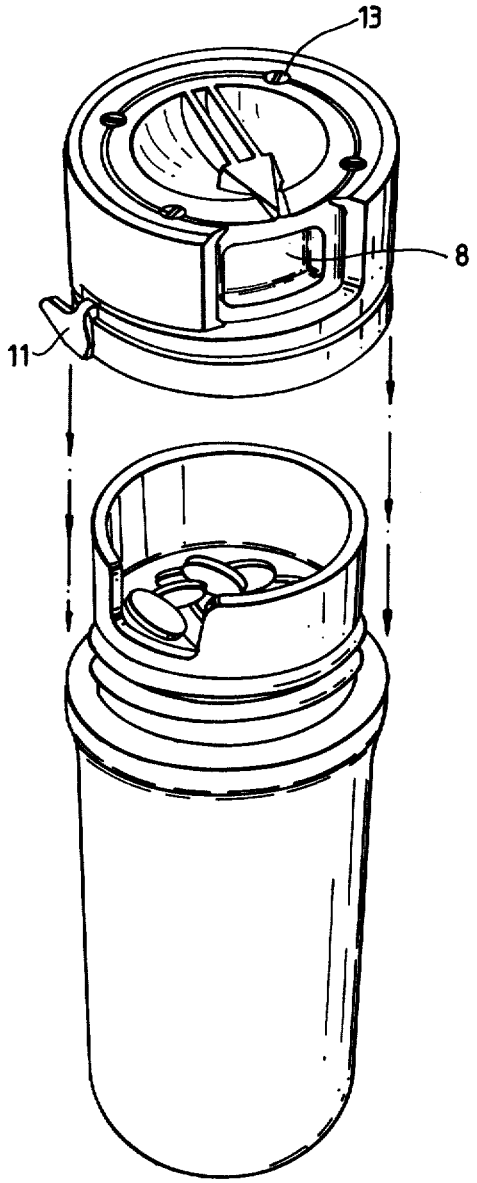
Figure 11:
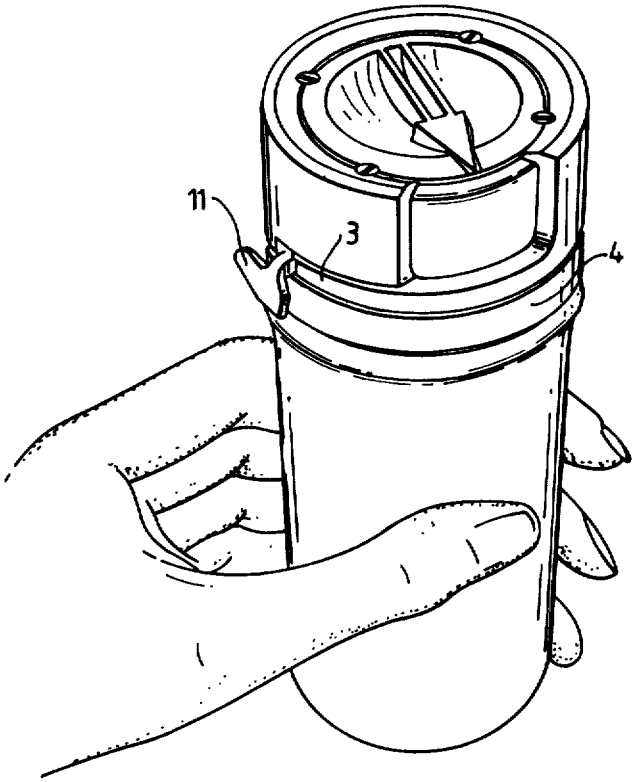
Figure 12:
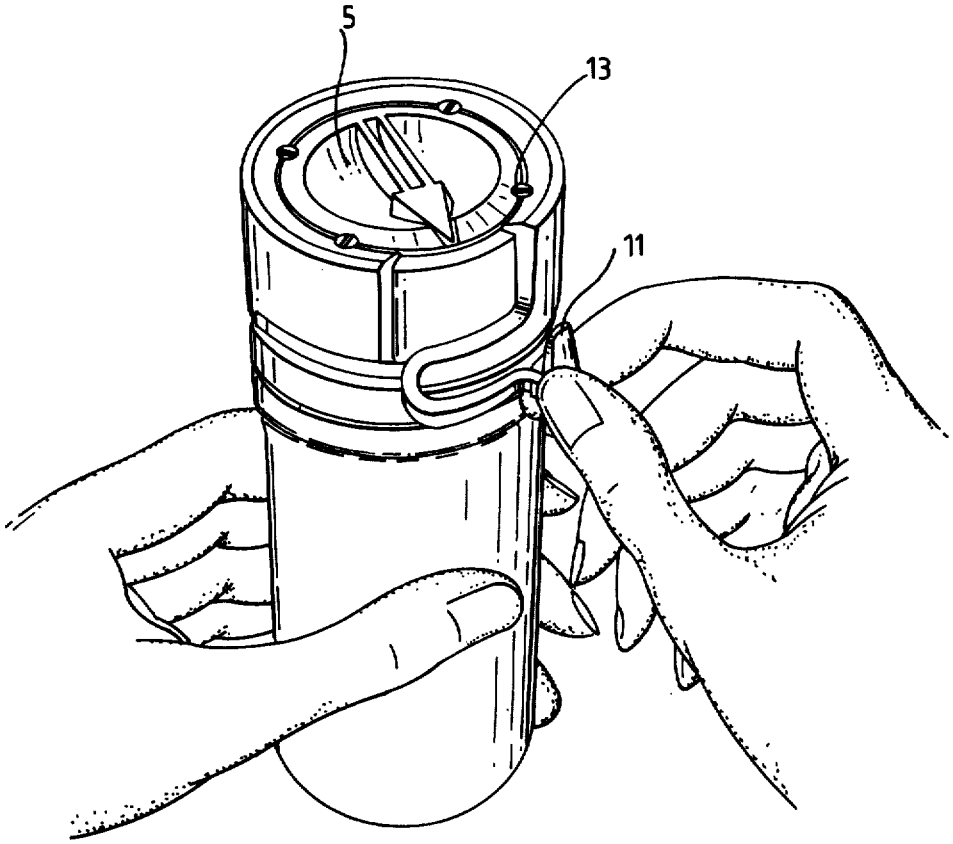

FIG. 4 is a side elevation of the closure from a different angle as compared with FIG. 2, FIG. 5 is a detail sectional view on line B—B of FIG. 1, FIG. 6 is a partial top plan view of the container, FIG. 7 is a longitudinal section on the line C—C of FIG. 6, FIG. 8 is a side view of the container in the direction of the arrow D in FIG. 6, FIG. 9 is a detail sectional view FIG. 10 is a pictorial view of the closure and container before assembly, FIG. 11 is a pictorial view of the assembled container and closure, and FIG. 12 is a pictorial view showing the tear band being torn away.

Referring first to FIGS. 1 to 5 the closure 1 has a plug 2, a tear band 3 and a collar 4. The closure also has a top 5 with an indicator 6, shown as consisting of an arrow, an opening 7 in the tear band 3 and a recess 8 in the plug 2. The tear band 3 is connected to the collar 4 by a lower line of weakness 9 and an upper line of weakness 10 is also provided. The tear band 3 is provided with a grip tab 11. The tear band 3 extends substantially to the top 5 of the closure 1 and is connected to the top 5 of the closure by a third line of weakness 2, tell-tale bridge members 13 also being provided. The tear band 3 and the collar 4 are provided with annular recesses 14 and the bottom part 15 of the plug is turned inwards to facilitate insertion of the closure into operative position and is curved to seal against the inner surface of the container. It should here be mentioned that the opening 7 is not provided for operational reasons but simply to facilitate moulding of the closure 1 as an integral unit including the recess 8. Without the opening 7 it would be impossible to mould the shape of the recess 8.

Referring now to FIGS. 6 to 9, the container 16 has an open mouth 17, a rim 18 with an opening 19 and external annular projections 20. The container 16 also has a shoulder 21. An alternative rim profile is shown by the dash lines 22. Referring now to FIGS. 10 to 12, it will be noted that the container 16 and closure 1 assembly is held in the hand 23 of a user, who then grips the tab 11 and starts to pull the tear band 3 thus breaking the lines of weakness 9 and 10. Continued tearing starts to break the upper line of weakness 12 and also the tell-tale bridge members 13.

When the tear band 3 is in position, with the lines of weakness 9, 10 and 12 intact and with the bridge members 13 unbroken as in FIG. 11, it is clearly evident to a user than the closure 1 has not been removed from the container 16 so that the contents of the container cannot have been tampered with since the assembly left the factory or laboratory. When the tear band has been removed the tamper-resistant feature has fulfilled its function because it is obvious that the band 3 has been torn away. However in this position the child-resistant feature comes into play because, unless the closure 1 is in the correct position there is no way in which the closure 1 can be removed from the container 16, because the closure 1 is in the form of a plug which is completely inside the outer wall of the container 16.

To remove the closure 1 it is necessary to manipulate the closure in such a way that the thumb recess 8 is in registration with the opening 19 in the rim 18 of the container 16. This is done by turning the closure 1 relatively to the container 16 and when in the correct position the closure can be removed in a flip-off movement.

We have therefore provided a tamper-resistant and child-resistant container and closure assembly wherein the closure has an outer skirt part with a tamper-resistant tear away band to co-operate with the container and an inner plug part connected to the tear away band by frangible tell-tale tongues to act as the tamper-resistant feature and wherein the plug part of the closure is shaped to cooperate with the container to provide a child-resistant feature, the container being shaped for appropriate co-operation with the closure.

It will be understood that the closure 1 may be applied to a container 16 by a simple downward push so that the collar 4 and the tear band 3 slide over the projections 20 into the position shown in FIG. 11. When in that position the closure 1 cannot be removed by a simple upward push because the recesses 14 and the projections 20 are shaped so that they can engage when the closure 1 is pushed downwards but cannot be disengaged by a push upwards, so that the closure cannot be removed in that way.

It will be understood that the collar 4 remains in position on the container 16 after the tear band has been removed. This is for aesthetic reasons and to cover the projections 20 which could be a hazard to a user if left uncovered.

I claim:

1. A container and closure assembly wherein the container has an open mouth, a rim around the mouth, a cut-out in the rim and annular closure retaining means below the rim and wherein the closure has a top to close the mouth of the container, an inner depending plug to enter the mouth of the container, a tear band, means shaped to engage with the closure retaining means on the container and thumb-receiving recess in the plug.

2. An assembly according to claim 1 wherein the annular closure retaining means on the container is in the form of a plurality of projecting beads under which the tear band fits.

3. An assembly according to claim 1 or 2 wherein the closure also has a collar disposed below the tear band and wherein the collar fits under the closure retaining means.

4. An assembly according to claim 1 wherein the closure also has a collar disposed below the tear band, wherein the tear band is connected to the collar by a lower line of weakness and wherein the tear band is connected to the upper part of the closure by an upper line of weakness.

5. An assembly according to claim 1 wherein the tear band extends substantially to the top of the closure and is connected to the top of the closure by a third line of weakness, tell-tale bridge members being provided to span the third line of weakness.

6. An assembly according to claim 3 wherein the tear band and the collar are provided with annular recesses and the bottom part of the plug is turned inwardly and is curved to act as a seal.

7. A container and closure assembly wherein the closure has an outer skirt part with a tamper-resistant tear away band to co-operate with the container and an inner plug part connected to the tear away band by frangible tell tale tongues to act as a tamper-resistant feature and wherein the plug part of the closure is shaped to co-operate with the container to provide a child-resistant feature, the container being shaped for appropriate co-operation with the closure.

8. A container and closure assembly wherein the container has an open mouth, a rim around the mouth, an opening in the rim and an annular closure retaining projection below the rim and wherein the closure has a top, an inner depending plug, a tear band, a collar, means shaped to engage with the closure retaining projection, a thumb-receiving recess in the plug, a lower line of weakness connecting the tear band to the collar, an upper line of weakness connecting the tear band to the upper part of the closure, a third line of weakness in the top of the closure and tell tale bridge members spanning the third line of weakness, the closure being angularly movable relatively to the container.

* * * * *

UNITED STATES PATENT AND TRADEMARK OFFICE

CERTIFICATE OF CORRECTION

PATENT NO. : 4,449,638

DATED : May 22, 1984

INVENTOR(S) : Eugene E. Davis

It is certified that error appears in the above-identified patent and that said Letters Patent is hereby corrected as shown below:

Column 1, line 58, "weakness 2" should be --weakness 12--.

Signed and Sealed this

*Nineteenth* Day of *February 1985*

[SEAL]

*Attest:*

DONALD J. QUIGG

*Attesting Officer*

*Acting Commissioner of Patents and Trademarks*